US005232118A

United States Patent [19]

Samuel

[11] Patent Number: 5,232,118

[45] Date of Patent: Aug. 3, 1993

[54] ELASTICALLY RIBBED BAG FOR LINING TRASH CONTAINERS

[76] Inventor: Dorothy Samuel, 230 Hargett Dr., El Dorado, Ark. 71730

[21] Appl. No.: 913,892

[22] Filed: Jul. 16, 1992

[51] Int. Cl.[5] ..... B65D 33/30

[52] U.S. Cl. ..... 220/404; 383/75

[58] Field of Search ..... 220/404; 383/72, 75

[56] References Cited

U.S. PATENT DOCUMENTS

| | | | |
|---|---|---|---|
| 3,940,052 | 2/1976 | McHugh | 220/404 |
| 4,267,928 | 5/1981 | Curry, Jr. | 220/404 X |
| 4,268,392 | 5/1981 | Hayes | 220/404 X |
| 4,388,739 | 6/1983 | Martinon et al. | 383/75 X |
| 4,878,764 | 11/1989 | Meyer | 383/75 X |
| 4,953,704 | 9/1990 | Cortese | 220/404 X |
| 4,989,994 | 2/1991 | Gelbard | 220/404 X |
| 5,078,508 | 1/1992 | Johan et al. | 383/75 |
| 5,133,607 | 7/1992 | Bonke | 220/404 X |

*Primary Examiner*—Steven M. Pollard

*Attorney, Agent, or Firm*—Hill, Steadman & Simpson

[57] ABSTRACT

A trash bag is provided with a stretchy elastic top to stretch over the mouth of a container to securely hold the top around the outside of the container and means are provided for effecting a pull tie to secure the bag closed.

1 Claim, 1 Drawing Sheet

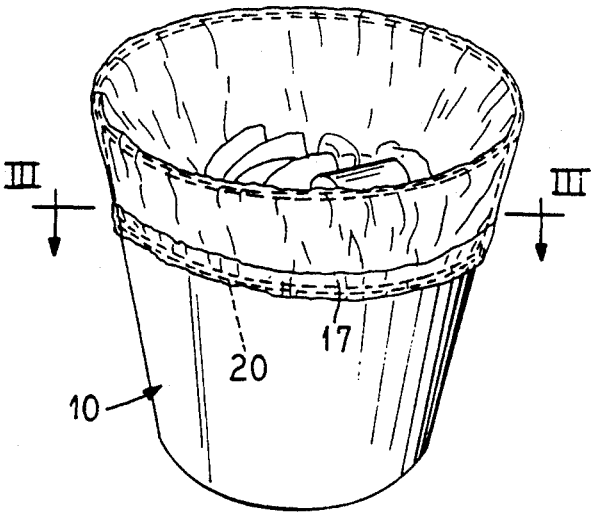
FIG. 2
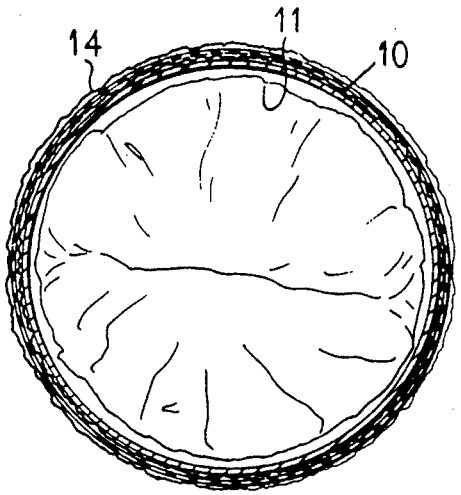
FIG. 3
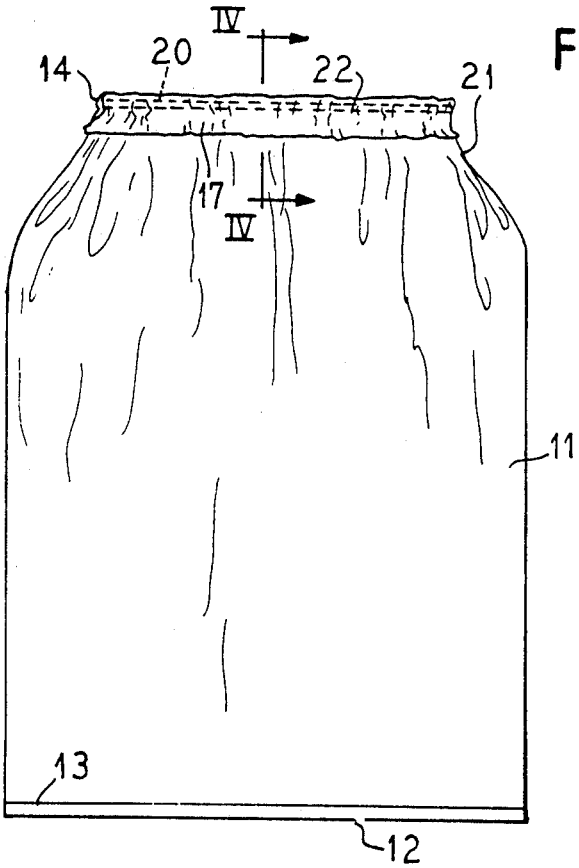
FIG. 1
FIG. 4
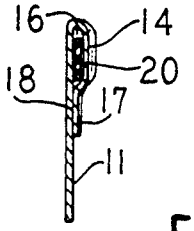
FIG. 6
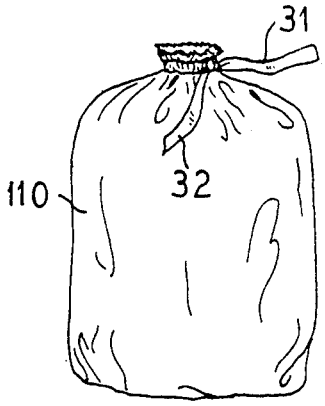
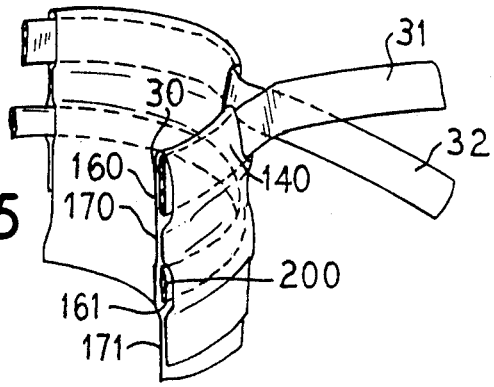
FIG. 5

ELASTICALLY RIBBED BAG FOR LINING TRASH CONTAINERS

BACKGROUND OF THE INVENTION

1. Field of the Invention

This invention relates generally to trash containers and more specifically relates to a trash bag with an elastic ribbing around the top of the bag to securely hold the bag in firm assembly with the top of the trash container.

2. Description of the Prior Art

A commonplace occurrence when you place trash in a garbage can that is lined with a trash bag is that the bag will oftentimes slip and slide down into the bottom of the trash container. Subsequent users compound the inconvenience of the situation by throwing garbage on top of the trash bag which necessitates having to pull the trash bag out from underneath the garbage.

With the alarm of AIDS and other diseases, extra care should be taken to prevent the spread of germs. This is particularly true in locations such as hospitals and in restaurants wherein the problems of trash disposal are considered particularly serious problems.

One prior art solution is to provide a U-shaped channel shaped in a circle over which the top of the trash bag is disposed whereupon an elastic band is looped over the edges of the bag and seated within the channel. Such device is customarily used on a trash cart and cannot be employed in combination with any trash container such as garbage can or a plastic covered barrel.

SUMMARY OF THE INVENTION

In accordance with the principles of the present invention, a trash bag is provided which has a stretchy or elastic top to stretch over the mouth of the container thereby to securely hold the top around the outside of the container. By virtue of such arrangement, only the inside of the bag need be contaminated. Further, when the bag is retrieved, the elastic may be utilized as a pull tie or separate string tie means may be provided whereby the bag may be secured in a closed condition.

More specifically, with a polyethylene trash bag, the leading edge of the mouth of the bag is folded back over itself and vulcanized or heat bonded to leave a channel which will contain a loop of elastic. The elastic will neck down the bag into firm assembly with the adjoining surface of a trash container. If desired, the elastic may be made accessible through slots enabling the user to pull the elastic and secure the bag closed.

DESCRIPTION OF THE DRAWINGS

FIG. 1 is a an elevational view of a trash bag embodying the principles of the present invention;

FIG. 2 is a view of a trash container in which the bag of FIG. 1 is used as a liner and showing how the elastic ribbing securely fastens the bag in assembly with the trash container;

FIG. 3 is a cross-sectional view taken on line III—III of FIG. 2;

FIG. 4 is a cross-sectional view taken on line IV—IV of FIG. 1;

FIG. 5 is a fragmentary view showing an alternative construction wherein an additional string-tie means is provided in combination with the elastic loop; and FIG. 6 is a view showing the bag of the present invention when filled with trash and secured closed.

DESCRIPTION OF THE PREFERRED EMBODIMENTS

The present invention can be used in a variety of configurations for all sizes and weights of trash bags and for many different sizes and shapes of trash cans and/or trash containers, whether made of metal, plastic or other material. Accordingly, it should be understood that the exemplification disclosed and claimed herein represents the best mode presently known to the inventor and is not to be construed as limiting the application of the principles of the present invention to particular shapes, sizes and configurations.

As shown on the drawings, a trash container is indicated generally at 10 which is of a general tubular configuration, i.e., the shape of the tube can be cylindrical as illustrated in FIG. 2 or the shape of the tube could be square or rectangular or some other geometric shape.

Almost everyone who has used a lined trash container such as the container 10 will have encountered the annoying problem of placing trash in the trash container 10 whereupon the liner bag will oftentimes slide down into the container. This either necessitates retrieving the bag and repositioning it over the edge of the container or else in a more aggravated situation, garbage will be thrown on top of the bag and thereby cause a mess for the subsequent user who has to end up by pulling the liner bag out from under the accumulated garbage.

In accordance with the principles of the present invention, a trash container liner bag is provided as shown at 11. The bag 11 has a generally tubular configuration corresponding in size and shape to the inside of the trash container 10. At a lower end shown at 12, the bag 11 is closed. In some constructions, where the individual bags are made from a continuous piece of tubing, it will be understood that the closed bottom 12 may be conveniently provided by vulcanizing or heat bonding the opposite walls of a tube as at 13, thereby forming a closed joint which will seal the bottom of the bag and prevent egress of the contents thereof.

In accordance with the principles of the present invention, an elastic ribbing means extends completely round the top peripheral upper end of the bag. If the bag is made of a thermal bonding material such as polyethylene or the like, the top peripheral upper end of the bag is folded back upon itself. As shown in FIG. 1 and FIG. 4, the reverse fold is a flange 14, a portion of which is spaced from the main wall to leave a channel 16 and the free end of the flange 17 is heat bonded or vulcanized by a welded joint indicated at 18. An elastic loop 20 extends through the channel 16 and has a girth sufficiently less than the upper end of the trash container 10 so that the elastic ribbing provided by the loop 20 and the flange 14 will neck down the bag 11 as shown in FIG. 1 at the neck down portion 21.

In accordance with the present invention, it is contemplated that the bag 11 will fit loosely within the trash container 10 whereupon the mouth of the bag 11 may conveniently be folded back upon itself over and embracing the upper circumferentially continuous edge of the trash container so that the elastic ribbing 14,20 will securely fasten the bag 11 to the trash container 10 regardless of what is placed in the bag.

It will be understood that the bag 11 is generally selected to be used with a trash container 10 in such size that the bag 11 is longer in length than the trash container 10 is deep. Accordingly, the bottom 12 of the bag 11 will rest on the bottom of the trash container 10 and there will be sufficient length in the bag 11 so that the mouth of the bag can be folded over the top of the trash container 10 as shown in FIG. 2.

If desired, the flange 14 may be slotted as at 22 thereby affording access to the elastic band 20. Thus, when the bag 11 is retrieved from the trash container 10, the elastic band can be utilized as a pull tie to secure the bag in the manner depicted in FIG. 6.

Alternatively, the flange 14 may be made sufficiently large or may be heat bonded in multiple locations to provide a double channel as depicted in FIG. 5. Thus, in that form of the invention, the bag is shown at 110 and has a flange 140 which is heat bonded at 170 and 171 to form a double channel 160 and 161. A string tie 30 is located in the channel 160 and has opposite ends 31 and 32 which are accessible as draw strings and may be used to draw up the bag in a necked down locked and secured position as shown in FIG. 6.

The elastic band is shown at 200 in FIG. 5 and is situated within the channel 161 so that it functions as already described to closely embrace and secure the bag 110 to the top of a trash container.

Although minor modifications might be suggested by those versed in the art, it should be understood that I wish to embody within the scope of the patent warranted hereon all such modifications as reasonably and properly come within the scope of my contribution to the art.

I claim as my invention:

1. In combination.

a trash container; and a trash container liner bag comprising:

a trash container having a generally tubular configuration with relatively rigid upstanding walls terminating in an upper circumferentially continuous edge forming a mouth for said container in which trash is received; and a trash container liner bag made of thermally bondable polyethylene plastic material and having a generally tubular configuration corresponding in size and shape to the inside of said trash container, said trash container liner bag being vulcanized by heat bonding at its lower end to form a closure at said lower end preventing egress of the contents of said bag;

said bag having an open upper end forming a mouth through which trash is charged into said bag; and an elastic ribbing means extending completely around the top peripheral upper end of said bag, said elastic ribbing means more particularly comprising a leading edge of said bag being hemmed and folded back upon itself and being vulcanized by heat bonding to form peripheral circumferentially extending channel means comprising a first channel and a second channel in parallel spaced relation to one another, and a connecting joint formed by heat bonding between said bag and a portion of said leading edge of said bag to connect said leading edge in firm assembly with the body of said bag, an elastic band in said first channel and having a diameter of such size as to neck down said mouth of said bag to a size smaller than its normal size, a tie band in said second channel by means of which said bag is selectively locked and closed, said second channel being externally slotted by means of which said tie band is accessed to pull-tie said tie band and secure said bag closed, said bag being longer in length than said trash container is deep;

the top peripheral upper end of said bag being folded back upon itself and embracing the upper circumferentially continuous edge of said trash container, said elastic band having a girth sufficiently less than the upper end of said trash container so that said elastic band holds said trash bag securely to said trash container no matter what is dropped thereinto, thereby to prevent said trash bag from slipping down into said container, whereby only the inside of the bag need be contaminated and said bag may be retrieved and tied for securement in a closed condition.

* * * * *